US006133811A

United States Patent [19]

Lau

[11] Patent Number: 6,133,811

[45] Date of Patent: Oct. 17, 2000

[54] APPARATUS FOR BENDING A FLEXIBLE CONDUIT

[75] Inventor: James Chung-Kei Lau, Torrance, Calif.

[73] Assignee: TRW Inc., Redondo Beach, Calif.

[21] Appl. No.: 09/310,362

[22] Filed: May 12, 1999

[51] Int. Cl.[7] ..... H01P 3/14

[52] U.S. Cl. ..... 333/241; 333/249; 333/72; 333/298; 72/298

[58] Field of Search ..... 333/241, 249, 333/239; 72/298, 301, 369, 387; 29/600

[56] References Cited

U.S. PATENT DOCUMENTS 5,289,710 3/1994 Lau ..... 72/298

*Primary Examiner*—Benny Lee
*Assistant Examiner*—Kimberly E Glenn
*Attorney, Agent, or Firm*—Michael S. Yatso; Ronald M. Goldman

[57] ABSTRACT

A bending mechanism for flexible waveguide uses a combination of an elongate arm (1), two short bracket arms (3 & 7) and a gear train (5, 11, 13 & 9) linking the bracket arms to bend a flexible waveguide (24) over a range of positions. The bend is formed to the shape of a circular arc the radius of which varies with the position. Each short bracket arm is pivotally connected (15 & 17) to a respective end of the elongate arm and to a respective one of the waveguide's two end flanges (23 & 25). Each bracket arm contains a gear that rotates with the respective bracket arm about the bracket arm's pivot; and an even number of gears interlinks those gears whereby pivotal movement of one of the flanges in a clockwise direction produces an effective relative pivotal movement of the other flange. The bending mechanism allows for as much as 180 degrees of repetitive reciprocal rotation of one flange relative to the other without imposing significant stress on the flexible waveguide, providing an ideal long lasting interface between a mechanically scanning microwave antenna and a microwave transmitter/receiver.

20 Claims, 3 Drawing Sheets

APPARATUS FOR BENDING A FLEXIBLE CONDUIT

FIELD OF THE INVENTION

This invention relates to bending of flanged flexible microwave waveguide transmission lines, and, more particularly, to controlled bending of a flexible waveguide during forced reciprocating movement of one end of the waveguide over a large circular arc, while the remaining waveguide end is held in a fixed position, such as occurs in the flexible waveguide used to couple a mechanically pivoted scanning antenna to a stationary microwave transmitter/receiver. In reciprocating over a wide angle the present invention forms the flexible waveguide from a straight configuration to a smoothly curved bend and then returns the flexible waveguide to the straight configuration, minimizing stress on the flange to waveguide connection and the waveguide walls.

BACKGROUND

Electrically conductive walled hollow metal waveguides, both rectangular and elliptical, have long served as a preferred form of transmission line through which to propagate high frequency electromagnetic energy RF, microwaves, between spaced locations. The electronic characteristics of those lines are well defined mathematically, the results predictable and the techniques to their construction well known. For most transmission applications such microwave waveguides are of a rigid structure. However, in microwave systems in which mechanical rotation is required of one part of the system, relative to another part held fixed in position, the transition between the two is often accomplished with a flexible waveguide: As example, one part of such a microwave system may be a microwave radar transmitter or transceiver that is maintained stationary; the second or movable part may be the microwave antenna, which is reciprocated over a predetermined arc to electronically "look" in different directions. Typically, the antenna is reciprocated back and forth over a wide arc continuously to electronically maintain surveillance over a prescribed region.

A length of waveguide typically includes a coupling device secured to each end, referred to as an end flange, or, simply, a flange. Those flanges contain bolt holes and a microwave window permitting the flanges to be bolted to like flanges of another device or waveguide, completing the microwave passage into the latter devices and thereby linking the waveguide into a microwave system, such as the microwave radar transmitter and the antenna previously referred to. Although the waveguide may be flexible in structure, the end flanges are necessarily quite sturdy and rigid, as is the attachment of those flanges with the waveguide's flexible metal walls.

The techniques of manufacturing flexible microwave waveguides so as to impart a characteristic flexibility that permits it to be bent or curved around a corner or the like, and that of the end flange construction and the flange's attachment to the waveguide are well known and require no description. Although the present invention, makes use of flexible waveguide and flanges, the construction details thereof are not material to an understanding of the invention and need not be described in detail.

Simple arcuate movement of one end of a length of flexible waveguide over a fixed axis of rotation while holding the other end stationary causes the effective length of the waveguide to change. The length is shortened, causing the waveguide to become compressed. That change is physically possible due to the flexible structure of the waveguide's construction. However, the large change in length, about ten per cent, occurring at large angles of rotation, such as sixty degrees or beyond from a straight configuration, induces high strains and stresses in the waveguide. That increment of length must be absorbed within the structure of the flexible construction or results in distortion of the shape of the waveguide as may cause buckling and large strains on the end flange connections with the waveguide.

The strain of repeated bending and unbending of the waveguide in normal operation ultimately causes the waveguide to mechanically break, setting a limit to the operation of the system, as may be expressed in terms of a number of bending cycles, at which time waveguide replacement is required. With conventional flexible waveguide construction, that high strain often causes the waveguide to buckle and fail prematurely, in less than 20,000 bending cycles. That is a factor of fifty times less than would occur when repeatedly bending only over small angles, where the change in waveguide length is very small and the accompanying mechanical stress insignificant.

In a prior invention, I've demonstrated that it is possible to reduce such high strains and stresses by controlling the shape of the bend during the arcuate movement of the waveguide end so as to minimize or avoid changing the waveguide's length. In my prior patent U.S. Pat. No. 5,289,710 granted Mar. 1, 1994, entitled Apparatus for Bending a Flexible Conduit, I describe a bending device and method for achieving such rotation that does not generate mechanical forces that augur change in the waveguide's length. That prior bending apparatus requires several special components to achieve the benefit of greater reliability. As inspection of disclosure of that patent reveals a bending apparatus that employs two variable length arms and a single rotation or pivot axis. An optimum rotation axis-to-flange distance, ie. the effective length of the arms, is the only variable parameter. The angle of rotation around the pivot point is the same as the angle of rotation of the moving flange.

As one appreciates, the structure of my prior bending device requires specially manufactured components, not available, so to speak, off-the-shelf. Further, for greatest operational life with that structure, it is found that the maximum range of angular rotation of the moveable flange should be no greater than ninety degrees. For a greater angular excursion larger sized components should be used, which poses other disadvantage and is not desirable.

Although the foregoing apparatus offers considerable benefit over the bending devices that preceded, the need for improvement, particularly in enhancing the permissible range of its angular excursion without concomitant reduction in the apparatus's operational life, is evident. The incentive thus exists to devise a less complicated and more easily assembled conduit bending apparatus which, at a minimum, equals the benefits provided by my earlier bending mechanism. As an advantage, the present invention provides a simpler solution and, yet, surprisingly, offers even greater advantage than my prior invention.

SUMMARY

A flexible waveguide containing receiving and transmitting ends is adapted to be repeatedly bent from a straight configuration into a curved configuration and then restored to the straight configuration. In accordance with the foregoing objects and advantages, the improved bending apparatus comprises first and second brackets or, as alternatively called, end arms fixed for relative rotation with respective ones of the waveguide's receiving and transmitting ends, suitably connected to the waveguide's end flanges at those respective ends; and a straight middle arm. The end arms are respectively pivotally attached to the straight middle arm at respective spaced locations, the pivots, adjacent the middle arm's ends defining pivot arms to permit each arm to pivot relative to the middle arm about the two pivots. Both the pivot arms are of the same length. A mechanical linkage between the two end arms supported by the straight middle arm forces one end arm to pivot counterclockwise relative to the straight middle arm when the other arm is pivoted clockwise relative to that middle arm.

More specifically, the mechanical linkage includes two additional gears, suitably, half gears or larger, attached to respective end arms centered at the pivot points for angular rotation with the respective end arms. The latter gears pivot with the respective bracket. Additionally, an even number of circular gears are rotationally mounted to the straight middle arm and define, with the two additional gears, a gear train that translates pivotal movement of one of the end arms in one direction to equal and opposite pivotal movement of the other end arm.

Suitably a motor or other driving device may be coupled to the free end of the middle arm, as example, at the pivot most distant from the fixed waveguide flange, to pivot the middle arm periodically back and forth about the other pivot located at the other end of the middle, while the end flange, attached to the end arm, is held stationary. In that way the opposite ends of the flexible waveguide and its end flanges are angularly oriented to one another by an arc or angle that is twice as great as the arc traversed by the free end of the straight middle arm during the latter's forced excursion, and the flexible waveguide bends into a circularly curved geometry during the transition.

In the preferred embodiment the gears associated with the end arms are of a fixed radius and the distance between the associated pivot attachment locations on the middle arm is fixed in length. In an alternative embodiment those gears instead contain a variable radius and the distance between pivot locations on the middle arm can change.

The present invention offers an improvement upon my prior invention. It uses two rotation axes at the optimum locations and three rotation arms to make the movable flange reach the optimum position and direction.

Instead of specially shaped templates and gears as in my prior invention, the present invention uses off-the-shelf gears, and, hence, is much easier to implement in practice. In my prior invention, the angle of rotation of the drive and the flexible waveguide flange are identical. In the present invention the drive rotation angle is only one-half the flange rotation angle. With the prior invention, it is almost impossible to rotate the flexible waveguide flange by one-hundred and eighty degrees. The present invention easily permits one-hundred and eighty degrees of flange rotation.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

DETAILED DESCRIPTION OF THE PREFERRED EMBODIMENTS

Figure 1:
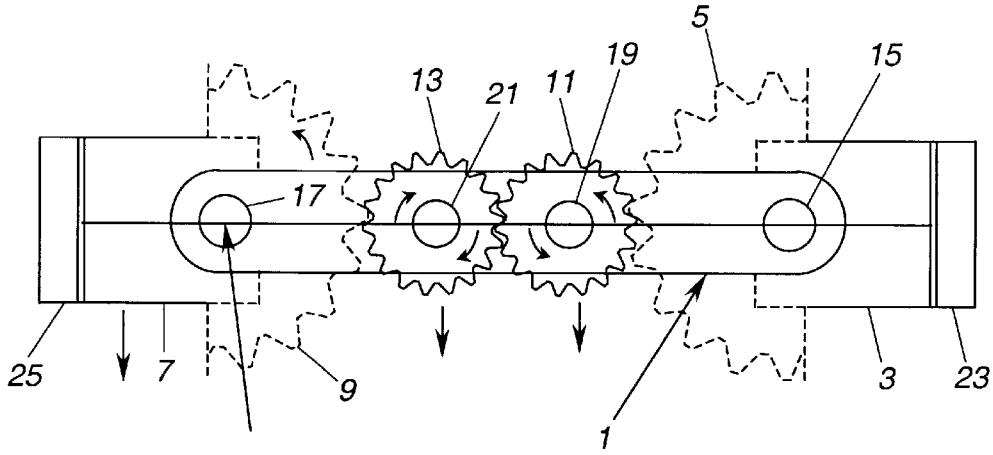
FIG. 1 illustrates an embodiment of the invention.

Reference is made to FIG. 1, which illustrates the components of the new bending mechanism. The structure includes a straight arm 1, referred to as the middle arm, containing relatively flat upper and lower surfaces and is relatively elongate in geometry, a flange attachment bracket or, as variously termed, end arm 3 containing an attached gear 5 integrally formed in or otherwise attached to the end arm, a second flange attachment bracket or end arm 7 also containing a gear 9 integrally formed in or otherwise attached to the end arm, and a pair of circular gears 11 and 13. Gears 5 and 9 are illustrated as being a half-gear, but three-quarter or full circular gears may be substituted. End arm 3 is pivotally mounted to the underside of the arm by a pivot pin 15 to define a pivot arm whose length extends from the distal end, at a flange, to the axis of pivot pin 15; and end arm 7 is pivotally mounted to middle arm 1 by pivot pin 17 to define another pivot arm whose length extends from the distal end, at a second flange to the flexible waveguide, to the axis of pivot pin 17. Gears 11 and 13 are rotatably mounted to the middle arm by respective pivot pins 19 and 21, which are positioned therein so that the two gears engage.

Gears 5 and 9 are essentially identical in structure. Likewise, circular gears 11 and 13 are identical. The latter gears are engaged as illustrated to form a gear train between gear 5 and gear 9 that interlocks the movement imparted to a waveguide flange by one of the gears 9 to the other gear 5. As example, rotation of end arm 7 and gear 9, which rotate together as unit for joint rotation, in a counter-clockwise direction, produces an equal and opposite rotation of gear 5, and, hence, end arm 3 in the clockwise direction.

Although gears 5 and 9 are referred to as half-gears, it should be understood that such typically includes a gear with teeth covering a greater circumference than one-hundred and eighty degrees, say 190 to 200 degrees, but less in size than a three-quarter gear. As a practical measure the greater circumference of gear teeth ensures that the mechanical load is spread amongst a number of adjacent gear teeth when the respective gears are near the end of rotation, that is, near the one-hundred and eighty degrees of rotation. As understood by those skilled in the art, that avoids premature failure of some gear teeth.

End arm 3 is attached to a flange 23 at the fixed end of the flexible waveguide, not illustrated in the figure, while end arm 7 is attached to flange 25 at the other end of that waveguide, which is the flange that is to be varied in relative arcuate position, as later herein described. As illustrated in side view in FIG. 2, the described elements are positioned together underneath a flexible waveguide 24, the waveguide being illustrated with its axis extending straight, referred to as the base position.

Flange 23, sometimes referred to herein as the fixed flange, is attached to the right end of the waveguide and serves as the passage for introducing microwave energy into the waveguide or permitting its exit. That flange is bolted to a corresponding flange that is stationary in position, such as, by way of example, a port of a microwave receiver/transmitter. That fixed connection may also serve to support the right hand end of the bending apparatus. Alternatively the right hand side of the bending apparatus may be supported by an additional bracket that is attached to the bottom end of pivot pin 15.

In application, flange 25, on the left hand side, is bolted to a mating port flange of the microwave system component that is to be reciprocated in position, typically a microwave antenna, as example, not here illustrated. If the antenna is light enough in weight, the antenna may be supported by the bending apparatus through the coupling with flange 25. More typically, such antenna will be mounted to a support that moves along a support surface, pictorially illustrated, and bears the antennas weight. That support surface also supports the foregoing waveguide bending mechanism of the invention.

A motor mechanism 27 that rides on an arcuate track 29, partially pictorially illustrated in the figure, is connected, as example, to middle arm 1 at pivot pin 17. In turn track 29 is fixed to the support surface. Through that connection the motor mechanism supports the left hand side of the bending assembly to the support surface. As later herein described, during operation, motor mechanism 27 pulls pivot pin 17 back and forth over an arcuate distance, pivoting pivot pin 17 and middle arm 1 about pivot pin 15, while pivot pin 15 remains fixed in position.

Figure 2:
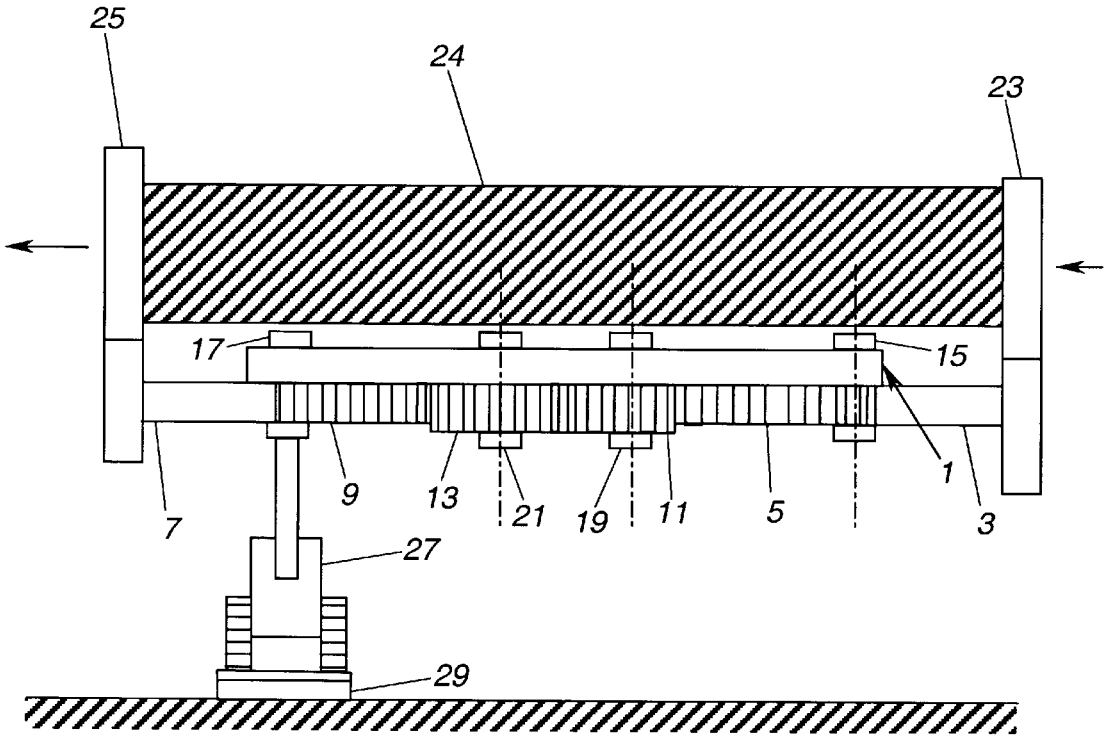
FIG. 2 illustrates the embodiment of FIG. 1 from the side.
Figure 3:
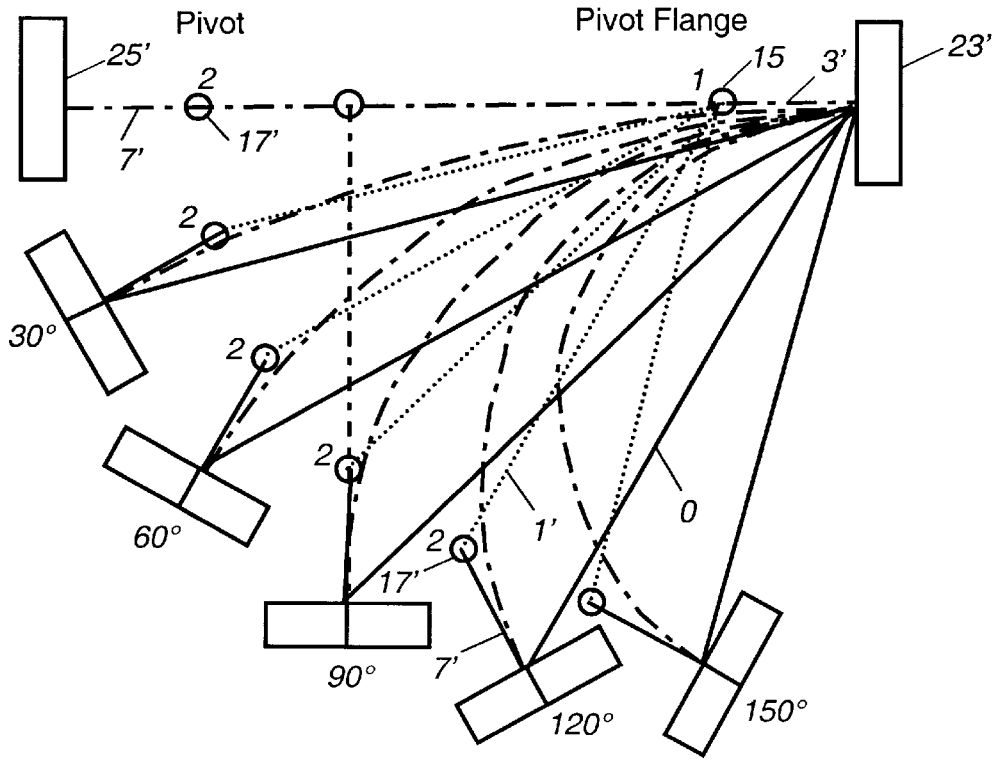
FIG. 3 pictorially illustrates the elements of FIG. 1 in consecutive stages of bending.

Reference is made to FIG. 3, which illustrates the waveguide bending mechanism at various angular positions in which flange 25 is sequentially positioned, relative to flange 23, during operation at respective angles of zero degrees, 30, 60, 90, 120 and 150 degrees. In the first or base position, where the two flanges 23 and 25 are parallel and the axis of the waveguide is straight, as was illustrated in FIG. 2, the flange 25 is in the position represented as Zero degrees. In that position the axis of waveguide 24 in the preceding figure is represented by a dash dot line. As earlier illustrated in FIG. 1, at this zero degree position the waveguide overlies middle arm 1 and the end arms 3 and 7 are also aligned straight. Hence, those elements are not separately represented at the zero degree position.

Motor mechanism 27, earlier illustrated, moves pivot 17, and the left end of arm 1, along the track, illustrated by the series of circles 2 in FIG. 3. That track extends in an arc that is defined by a radius equal to the distance between pivot points 15 and 17', centered at pivot 17', and subtending an angle of seventy-five degrees or one-half the angle attained by flange 23.

In the other angular positions, the straight arm 1 is illustrated by a line formed with a series of closely spaced dots 1', the length of bracket 7 between the pivot point 17 and flange 25 is represented by a straight solid line 7' and that between pivot point 1 and flange 3 by the straight horizontal portion of 24' between those two locations. Those elements are most visible in the 150 degree orientation of flange 25 shown at the lower right hand side of the figure. As shown, even at this extreme position, flexible waveguide 24' is formed in a smooth circular curve that extends between flange 23 and 25. The bending mechanism however is defined by three straight lines between the same two locations, representing the main arm 1 and the two pivotally mounted end arms, 7 and 3, that extend between the pivot axis and the flanges, 23 and 25, respectively associated therewith.

If rotation of flexible conduit 24 is achieved such that the center line length of the conduit remains unchanged throughout rotation, the flexible conduit can be expected to take the shape of a portion of a uniform radius circle. Accordingly, the resultant radius of curvature is maximized and the stress and strain within the flexible waveguide and between the end flanges and the waveguide walls are minimized. To thereby minimize stress on waveguide 24 during bending the axis of the waveguide, and hence the waveguide, should curve from the straight line at the base position, into a circular arc at each step of the bend through to the maximum angle through which the waveguide is to be bent during operation, such as pictorially illustrated in the top view of FIG. 3. Those circular arcs vary in radius, from the largest radius as flange 25 is rotated from the vertical position in the figure to the smallest radius when the flange is rotated to the 150 degree position.

The foregoing is essentially accomplished by setting the dimensions of the length of the end pivot arms, that is, the distance from the pivot center to the associated flange for each of end arms 3 and 7 at 0.180 L, where L is the length of the flange-to-flange length of waveguide 24, and the distance between the end arm pivots 15 and 17, referred to herein as the "middle pivot arm 1" at 0.64 L.

It is also possible to vary the foregoing dimensions to less optimum values while not significantly increasing the stress on waveguide 24, that is, not causing the waveguide to curve in a geometry materially different from a circular arc, by setting the pivot to flange length of the end pivot arms at any length from 0.17 L to 0.18 L and setting the length of the middle pivot arm 1 to a value from 0.66 L to 0.64 L.

To avoid potential confusion at this juncture, a clarification of the terminology introduced should help to better understand the preceding two paragraphs and the description which follows. The numbers used to identify the end arms are also used again to identify the pivot arms subsumed in those end arms. It is recognized that each of the end arms, 3 and 7, are greater in length than the pivot arms which they subsume and define. As example, end arm 3, as illustrated in FIG. 1, can physically extend from the flange 23, laterally past the pivot 15. However, the end pivot arm that is subsumed therein, extends between the end of the flange and the axis of pivot 15. Thus when reference is being made to "end arm 3", what is intended is the physical configuration of the arm, such as illustrated. However, when reference is made to "end pivot arm 3", what is intended is the length of the end arm between the axis of the associated pivot 15 and the distal end of that arm at the associated waveguide flange.

Further, the number used to identify middle arm 1 is also used to refer to the "middle pivot arm", that is subsumed therein. Thus, when making reference herein to the length of the central or middle pivot arm 1 in the description of the design and operation that follows, what is being referred to is the distance between the axes of pivot points 15 and 17 in FIG. 1 along the middle arm 1, earlier illustrated in FIG. 1. The middle pivot arm 1 is thereby subsumed within middle arm 1.

As example, the material in middle arm 1 to the left of pivot 17 and to the right of pivot 15 are essentially not relevant to the theory of operation of the apparatus and to the calculations that are given later herein. The function of that extra material is to aid in holding pivots 15 and 17 to the center arm. Where, as example, in FIG. 1, pivot 15 is inserted in a circular hole through the arm and remains fixed in lateral position, some of the material in middle arm 1 to the right of that pivot's axis forms a side to the hole, which mechanically holds the pivot in place on the arm. However, in the alternative embodiment later herein described, pivots 15 and 17 are mounted in slots in the middle arm, instead of holes, so that the relative position of and the spacing distance between the axes of those two pivots can change, effectively changing the length of the middle pivot arm 1, but leaving the overall mechanical length of middle arm 1 unchanged.

Returning to the discussion of FIG. 3, if rotation of flexible conduit 24 is achieved such that the center line length, L, of the conduit remains unchanged throughout rotation, the flexible conduit can be expected to take the shape of a portion of a uniform radius circle. Accordingly, the resultant radius of curvature is maximized and the stress and strain within the flexible waveguide and between the end flanges and the waveguide walls are minimized.

The mathematical formulation to the problem of forming the waveguide into an arc of a circle is to maintain a constant waveguide center line length throughout rotation. The distance from the instantaneous axis of rotation to either the flexible end or, as variously termed, antenna end, at flange 25 is equal in magnitude to the distance from the instantaneous axis of rotation to the fixed or receiving end at flange 23. Through use of plane geometry and trigonometry it may be shown that this distance can be expressed mathematically by the following equation:

$$D = \frac{L_0}{\theta}\tan\frac{\theta}{2}$$

where θ is the angle of rotation of the flange expressed in radians, and $L_0$ is the length of the flexible conduit 24.

Figure 4:
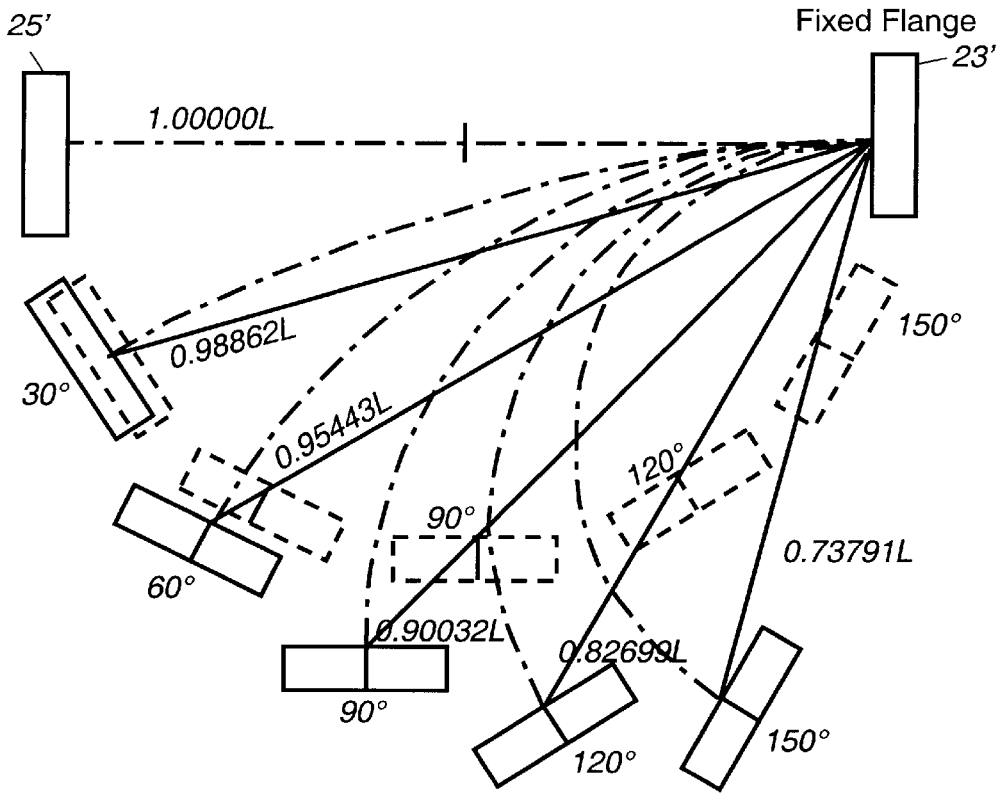
Figure 4 Prior Art
FIG. 4 pictorially illustrates the elements of my prior invention for assisting in the explanation of the preferred embodiments.

FIG. 4 graphically illustrates the flange location as a function of flange rotation angle θ for the single pivot point rotation single variable arm length of my prior bending mechanism described in my prior patent U.S. Pat. No. 5,289,710. The optimum flange locations, obtained through solution of the foregoing equation, are indicated by the solid line rectangular boxes representing the movable flange 25' on the left end of the waveguide 24' and the flange that is fixed in position 23' on the right hand side in the figure.

The optimum straight line physical distance between the rotating flange 25' and fixed flange 23' at various rotation angles θ is indicated and may be tabulated as follows:

At the base position or θ equals zero degrees rotation, the flange to flange distance is equal to L;

at θ of 30°, the distance is 0.98862L;

at θ of 60° that distance is 0.95493L;

at a θ of 90° that distance is 0.90032L;

at θ of 120° the distance is 0.826996L; and at a θ of 150° that distance is 0.73791L.

The single pivot point rotation flange locations, that is by bending the flexible waveguide, are indicated by the rectangular boxes illustrated in dash line. The foregoing may be compared with those previously observed in FIG. 3, which graphically illustrates the location of the optimum pivot points and rotation arms.

A numerical analysis of the lengths of the elements used in the prior double adjustable arm and single pivot point bending apparatus taken with respect to various angles of rotation of the supported flange conveniently serves as a basis for the selection of the dimensions of the present triple arm and double pivot point bending mechanism of FIGS. 1 and 2. Such numerical analysis is based on the assumption that the rotation of the three arm embodiment is the same as that occurring with the prior double adjustable length arms and single pivot point bending mechanism described in my prior patent. Such a numerical analysis is conveniently tabulated in a spreadsheet.

Considering the length L of the flexible waveguide as the unit of measure, that is, 1.0, and expressing the length of the three pivot arms in terms of the length of the waveguide, the numerical analysis is obtained by determining each of the quantities and relationships set forth hereafter for each flange rotation angle θ over a range of angles of θ taken, say, between 10 and 178 degrees in 10 degree increments, and expressed in degrees of arc (A).

Further, an appendix to this application, which the interested reader may procure, contains Tables 1 and 2 that together represent a single spreadsheet containing a tabulation of numerical values obtained by the following numerical analysis. As a convenience to those who obtain a copy of the appendix, the alphabetic reference in parentheses that follows each of the foregoing statements or equations, represents a like labeled column in the Appendix table 1 and/or table 2.

(1) The angle θ, representing the movable flange's rotation, specified in degrees, (A).

(2) The angle of (θ/2),(B). This is the rotation of the middle pivot arm 1 relative to the base line axis when the waveguide is straight, and this angle is equal to one half of the flange rotation.

(3) The arc (θ/2), which is the angle in (2) expressed in radians, (C).

(4) The tangent of that angle (θ/2), (D).

(5) The sine of that angle (θ/2), (E).

(6) The tangent (θ/2) divided by 2 arc(θ/2), (G), ie. (D/2C).

Multiplying the value obtained in calculation (6) by L, obtains the arm length desired in the prior two-arm single pivot point bending apparatus. Doubling that value obtains the combined length of the two rotating arms when there is no third middle arm, which is the situation in my prior patent.

(7) The sin(θ/2) divided by arc (θ/2), (H).

The value at calculation (7) derives the straight line distance between the ends of the flexible waveguide, to the rear end of the waveguide flanges, at corresponding angles of rotation. This equates to the total arm length of the center or middle pivot arm 1 of FIG. 1, if, in a hypothetical case, the length of each of the two end pivot arms 3 and 7 of FIG. 1, is reduced to zero, that is, are omitted.

(8) A value of [(sin(θ/2))/(arc(θ/2))] less 2[(tan(θ/2))/(2 arc(θ/2))], (I), ie, [(H)−2(G)].

Calculation (8) obtains the total arm length adjustment range. That adjustment range extends from having a middle pivot arm 1 whose length is maximum, to end pivot arms, 3 & 7, whose length is a maximum.

(9) The value of 1, which is the length of the waveguide, less the quantity

[(sin(θ/2))/(arc(θ/2))], J, ie. (1−H).

Calculation (9) derives the total arm length increase or increment in length that is necessary to bring the total arm length, ie, middle pivot arm 1 and end pivot arms 3 & 7, to the length of the waveguide, L, assuming initially that end pivot arms 3 & 7 are of length zero. The longer the end arm length required, then the longer would be the total arm length, ie. the combined length of pivot arms 1, 3, & 7.

(10) The value [[1−[(sin(θ/2))/(arc(θ/2))]]×[(tan(θ/2))/(2 arc(θ/2))]]/[[(sin(θ/2))/(arc(θ/2))]−2[(tan(θ/2))/(2 arc(θ/2))]], (K), ie. (J×G)/(I).

Calculation (10) derives the optimum axis location.

(11) the radius of curvature of the circular arc formed by the flexible waveguide, which is 1.0 in length, divided by twice the value of arc (θ/2), (N).

From the foregoing calculations one finds that the optimum axis of rotation at a small angle, that is, 90 degrees or less, is close to 0.17L in value. With the axis of rotation considered at 0.17L, the corresponding center pivot arm length, that is middle pivot arm 1 of FIG. 1, is found to be about 0.66L.

(12) the cosine of (θ/2), (O);

The following set of values are determined with the axis of rotation selected at the distance of 0.17 L from the flange.

(13) The value 2(0.17)L cos(θ/2), (P).

(14) The total length of the center pivot arm and the two end pivot arms, ie. 2(0.17)L cos(θ/2)+0.66 L, (Q), ie. (P)+0.66.

(15) The value [2(0.17)L cos(θ/2)+0.66 L]−[[sin(θ/2)]/[arc (θ/2)]], (R), ie. (Q−H).

This is the value of the center arm adjustment, calculated by subtracting [sin(θ/2)]/[arc(θ/2)], the straight line distance between the ends of the flexible waveguide, from the total length of the pivot arms.

(16) The value obtained by adding the result of calculation (15) to 0.66, (S), ie (R+0.66).

This determines the optimum center pivot arm 1 length, calculated by adding the center arm adjustment to the pivot arm length determined with the axis at 0.17L from the flange.

The 0.17L length end pivot arms 3 & 7 would cause the center of the waveguide to separate by the distance 0.34 cos(θ/2), column P, ie. 0.34 multiplied by column(O), the end arm length component parallel to the middle pivot arm. The distance between the ends of the flexible waveguide is 0.34 cos(θ/2)+0.66, column Q, ie. P+0.66. Since the optimum distance between the ends of the waveguide is [sin (θ/2)]/[arc (θ/2)], column H, the center pivot arm adjustment, [0.34 cos(θ/2)+0.66]−[sin (θ/2)]/[arc (θ/2)], column R, would cause the waveguide end to reach the optimum location.

Calculations (14), (15) and (16) are repeated for each of two additional axis to flange distances of 0.175L and 0.180 L, which are summarized in Table 2 columns T, U, V & W and X, Y, Z & AA, respectively.

From such a numerical analysis, one finds that the shorter end pivot arm length, ie. 0.17 L is better for small angle rotation, under 90 degrees. For 90 degree flange rotation, the 0.17 L pivot arm length achieves the optimum condition with less that 0.0005 L middle pivot arm length change or adjustment. The latter adjustment, however, is less than 1/10th of 1 per cent of the center (middle) arm 1 length, 0.66 L.

Such an adjustment is negligible and may be disregarded. By disregarding such adjustment, one avoids the need for the additional structure necessary to adjust the middle arm's length. The design of the bending mechanism is therefore kept simple and leads to the preferred design of FIGS. 1 and 2.

By instead using the 0.175 L flexible flange arm length, it is seen that a 0.003 L middle pivot arm length adjustment allows flange rotation through 150 degrees. The optimum middle arm length is shortest at a 100 degree flange rotation and the maximum optimum middle pivot arm length occurs at a 150 degree rotation. The rotation through 90 to 150 degrees requires more optimum middle pivot arm length adjustment than the zero to 90 rotation. When the flange rotation angle is small, the arm length adjustment is also small. It is seen a length adjustment of one-half of one per cent changes the radius of curvature by less than one percent. In practical application this adjustment is also regarded as negligible.

A gear train containing gears 11 and 13 are used to ensure that the flange rotation around each of the two pivot axes 19 and 21 is identical. Using an even number of identical gears between the two axes of rotation ensures that the moving end pivot arm 7' rotates through an angle that is twice as large as the middle arm 1 rotation angle.

Figure 5:
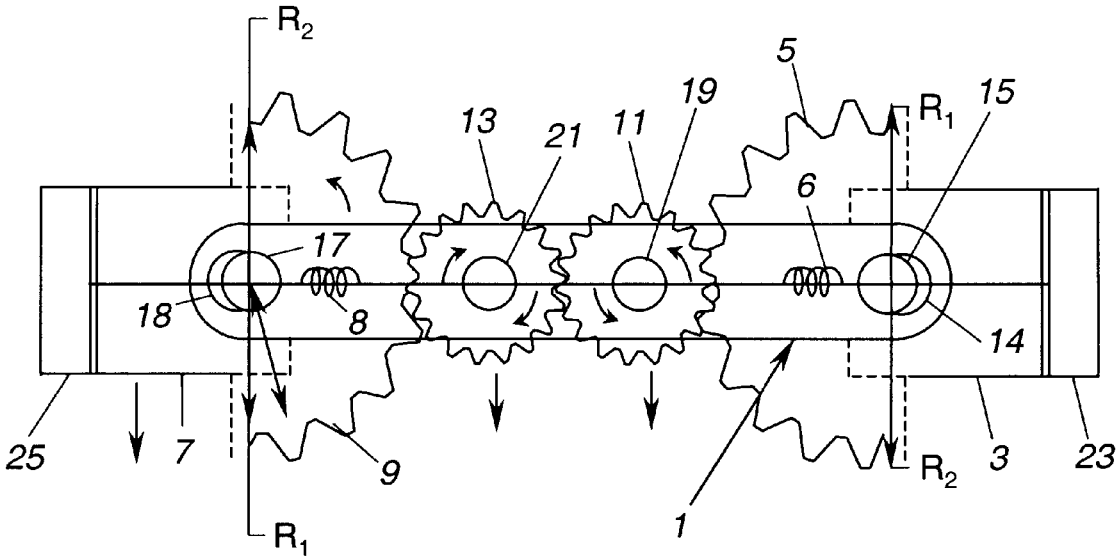
FIG. 5 illustrates an alternative embodiment of the present invention.

If one considers the ½ of 1% dimensional change in the length of the center arm 1 to be too great to disregard, the foregoing embodiment can be easily modified to take that minuscule amount into account, although a more complex structure results. Such a modified embodiment is illustrated in FIG. 5 to which reference is made. For convenience, those elements in the embodiment of FIG. 5 that are the same as elements in the prior embodiment carry the same numeric identification; and, where the corresponding element is modified, that element is identified by the same number and is primed.

As shown, this embodiment contains the same number of gears and arms as before, and, additionally, includes a pair of springs 6 and 8. Gears 5' and 9', which have their centers at the respective axes of rotation of the end pivot arms 3 and 7, are made to have a variable radius that increases in radius as the respective gear rotates. That change in radius should be one half of the center arm adjustment value. Thus as gear 5' is rotated clockwise, its radius increases from the smaller radius, R1, to the largest radius, R2, at the maximum angular rotation. Gear 9', which rotates contra to gear 5' also increases in radius from R1 to R2 at the maximum counter-clockwise angular rotation.

Laterally or, as variously termed, axially extending slots 14 and 18, illustrated by dash lines, are required in center arm 1, instead of the small holes. The pivots, 15 and 17, supporting gears 5' and 9', respectively, are mounted within a respective slot, permitting the pivots to move laterally on arm 1, as changes the length of the middle pivot arm 1. Spring 6 connects between pivot 15 and a location within arm 1, such as at the pivot of gear 19, and biases pivot 15 toward the left end of the slot. Spring 8, connected between pivot 17 and a location within arm 1, such as at the other pivot 21, biases pivot 17 toward the right end of slot 18. The intermediate gears 11 and 13 remain fixed in laterally position on the arm and can only rotate to couple angular rotation of one pivot arm gear, such as 9' to the other, 5'.

It is seen that as gears 5' and 9' angularly orient to the larger radius, the respective axes of rotation, namely the respective pivots 15 and 17, are forced to move further apart laterally on arm 1 against the bias of the springs, thereby increasing the length of the middle pivot arm 1, while moving the end pivot arms outwardly. Effectively then, when the rotation in the modified embodiment attains larger angles of rotation, the center pivot arm is effectively lengthens. The reader is reminded that the physical length of arm 1, as distinguished from the portion thereof between pivots 15 and 17 referred to as center pivot arm 1, remains unchanged.

The half gears 5' and 9' would have various radii such that the radius is modified by one half the value indicated in column R for the corresponding angles of rotation. Similar calculation may be made for the end arm length of 0.1667L so that the value for radius adjustment is always positive, that is increases with the increase in rotational angle. Even though end pivot arm lengths 3 and 7 of less than 0.16 L or greater than 0.185 L, according to the foregoing numerical analysis, are not found optimum, using such non-optimum end pivot arm lengths is possible in the alternative embodiment by employing a middle pivot arm for such embodiment that automatically adjusts in length.

Considering the foregoing embodiments, in my invention the end pivot arms can range in length between 0.15 L to 0.25 L, L being the length of the flexible conduit, and the middle pivot arm can be of values between 0.5 L and 0.7 L, with the total length of the three arms being from 0.95 L to and including 1.05 L. As is appreciated, the complexities introduced by the latter embodiment detracts from the more practical benefit of simplicity, and, hence, are less preferred than the first embodiment.

It is believed that the foregoing description of the preferred embodiments of the invention is sufficient in detail to enable one skilled in the art to make and use the invention. However, it is expressly understood that the detail of the elements presented for the foregoing purpose is not intended to limit the scope of the invention, in as much as equivalents to those elements and other modifications thereof, all of which come within the scope of the invention, will become apparent to those skilled in the art upon reading this specification.

As example, FIGS. 1 and 2 illustrated an embodiment using only four gears. However, as those skilled in the art appreciate four intermediate circular gears or any even number of intermediate gears is also acceptable since the even number of intermediate gears ensure that the two pivot to flange arms 3 and 7 rotate in opposite directions over identical arcs. Thus the invention is to be broadly construed within the full scope of the appended claims.

What is claimed is:

1. Bending apparatus for a flexible waveguide, said flexible waveguide including first and second ends and each of said first and second ends including respective first and second waveguide end flanges, comprising:

a first bracket attached to a first one of said waveguide end flanges;

a second bracket attached to the second one of said waveguide end flanges;

an elongate arm;

a first pivot for mounting said first bracket to one location on said elongate arm, wherein said first bracket is pivotable relative to said elongate arm, said first pivot including a pivot axis;

said first bracket defining a first end pivot arm for said first waveguide end flange, said first end pivot arm extending between said pivot axis of said first pivot and said first waveguide end flange;

a second pivot for mounting said second bracket to a second location on said elongate arm, said second location being spaced from said first location, wherein said second bracket is pivotable relative to said elongate arm, said second pivot including a pivot axis, and;

said second bracket defining a second end pivot arm for said second waveguide end flange, said second end pivot arm extending between said pivot axis of said second pivot and said second waveguide end flange;

said first end pivot arm and said second end pivot arm being of equal length;

a first gear attached to said first bracket for joint coaxial pivotal movement therewith;

a second gear attached to said second bracket for joint coaxial pivotal movement therewith;

said first and second gears being of like structure;

a gear train carried by said elongate arm, said gear train being coupled between said first gear and said second gear for translating pivotal movement of said first gear in one direction to equal and opposite pivotal movement of said second gear, and vice-versa, whereby pivotal movement of said one location of said elongate arm relative to said second location of said elongate arm over a predetermined arc produces a change in relative angular position of said first and second waveguide end flanges equal to twice said predetermined arc.

2. The invention as defined in claim 1, further comprising:

motor means for periodically pivoting said first location on said elongate arm from a base position over a predetermined arc about said second location on said elongate arm and then pivoting said first location back through said predetermined arc to return to said base position.

3. The invention as defined in claim 1, further comprising:

motor means for periodically pivoting said elongate arm from a base position over a predetermined arc about said second location on said elongate arm and then pivoting said elongate arm back through said predetermined arc to return to said base position.

4. The invention as defined in claim 1, wherein said flexible waveguide comprises a length L, and wherein each of said first and second end pivot arms comprises a length selected from a range of values from 0.17 L to 0.18 L and wherein said pivot axes of said first and second pivots are spaced apart on said elongate arm by a distance of from 0.66 L to 0.64 L.

5. The invention as defined in claim 1, wherein said flexible waveguide comprises a length L, and wherein each of said first and second end pivot arms comprise a length of 0.18 L and wherein said pivot axes of said first and second pivots are spaced apart on said elongate arm by a distance of the range of 0.65 L to 0.64 L.

6. The invention as defined in claim 5, wherein said pivot axes of said first and second pivots are spaced apart on said elongate arm by a distance equal to 0.64 L.

7. The invention as defined in claim 1, wherein each of said first and second gears comprise a half-gear.

8. The invention as defined in claim 5, wherein each of said first and second gears comprise a half-gear.

9. The invention as defined in claim 1 wherein each of said first and second gears comprise variable radius gears.

10. Apparatus for pivoting one end of a hollow flexible conduit relative to the other end thereof to produce a smoothly curved bend in said hollow flexible conduit, comprising:

a first flange for attachment to one end of said conduit;

a second flange for attachment to the other end of said conduit;

an elongate arm;

a first pivot for mounting said first flange to one location on said elongate arm for rotation thereabout, wherein said first flange is rotatable relative to said elongate arm;

said first flange being spaced from said first pivot by a predetermined distance;

a second pivot for mounting said second flange to a second location on said elongate arm for rotation thereabout, wherein said second flange is rotatable relative to said elongate arm;

said second flange being spaced from said second pivot by said predetermined distance;

said second location on said elongate arm being spaced from said first location thereon;

a first gear attached to said first flange for joint rotational movement coaxial with rotational movement of said first flange;

a second gear attached to said second flange for joint rotational movement coaxial with rotational movement of said second flange;

a gear train coupled between said first gear and said second gear for translating pivotal movement of said first gear in one direction to equal and opposite pivotal movement of said second gear, whereby rotational movement of said one location of said arm relative to said second location of said arm over a predetermined arc produces a change in relative angular position of said first and second flanges equal in amount to twice said predetermined arc.

11. The invention as defined in claim 10, further comprising driver means for periodically rotating said first location on said arm about said second location on said arm from a base position over a predetermined arc and then back through said predetermined arc to said base position.

12. The invention as defined in claim 10, further comprising driver means for periodically rotating said elongate arm about said second location thereon from a base position over a predetermined arc and then pivoting said elongate arm back through said arc to return to said base position.

13. The invention as defined in claim 10, wherein each of said first and second gears comprise a half gear.

14. The invention as defined in claim 10, wherein each of said first and second gears comprise a variable radius; wherein said first location in said elongate arm includes a first slot, said first slot extending axially in said arm a predetermined length; wherein said second location in said elongate arm includes a second slot, said second slot extending axially in said arm said predetermined length; and wherein said first and second pivots are respectively pivotally mounted through said first and second slots and are movable in said respective slots in a direction along the axis of said elongate arm.

15. The invention as defined in claim 11, wherein each of said first and second gears comprise a variable radius; wherein said first location in said elongate arm includes a first slot, said first slot extending axially in said arm a predetermined length; wherein said second location in said elongate arm includes a second slot, said second slot extending axially in said arm said predetermined length; and wherein said first and second pivots are respectively pivotally mounted through said first and second slots and are movable in said respective slots in a direction along the axis of said elongate arm.

16. The invention as defined in claim 10, wherein said flexible conduit comprises a length L; wherein the distance between the axis of said first pivot and the distal end of said first flange defines a first end pivot arm; wherein the distance between the axis of said second pivot and the distal end of said second flange defines a second end pivot arm; wherein the distance from the center of each of said first and second locations defines a center pivot arm; wherein each of said first and second end pivot arms comprises a length selected from a range of values from 0.17 L to 0.18 L and wherein said central pivot arm is of a length of from 0.66 L to 0.64 L.

17. The invention as defined in claim 10, wherein said flexible conduit comprises a length L; wherein the distance between the axis of said first pivot and the distal end of said first flange defines a first end pivot arm; wherein the distance between the axis of said second pivot and the distal end of said second flange defines a second end pivot arm; and wherein each of said first and second end pivot arms comprise a length of 0.18 L and wherein said pivot axes of said first and second pivots and the center of said first and second locations are spaced apart on said elongate arm by a distance of from 0.65 L to 0.64 L.

18. The invention as defined in claim 17, wherein said pivot axes of said first and second pivots and said centers of said first and second locations are spaced apart on said elongate arm by a distance of 0.64 L.

19. The invention as defined in claim 15, wherein said flexible conduit comprises a length L; wherein the distance between the axis of said first pivot and the distal end of said first flange defines a first end pivot arm; wherein the distance between the axis of said second pivot and the distal end of said second flange defines a second end pivot arm; wherein the distance from the center of each of said first and second locations defines a center pivot arm; wherein each of said first and second end pivot arms comprises a length selected from a range of values from 0.17 L to 0.18 L and wherein said central pivot arm is of a length of from 0.66 L to 0.64 L.

20. The invention as defined in claim 15, further comprising:

a first spring for applying a pulling force to said first pivot in a first direction along the axis of said elongate arm to bias said pivot toward one end of said first slot; and a second spring for applying a pulling force to said second pivot in a second direction along the axis of said elongate arm to bias said pivot toward one end of said second slot.

* * * * *